United States Patent [19]

Thornton et al.

[11] Patent Number: 4,953,731

[45] Date of Patent: Sep. 4, 1990

[54] KEYLESS LOCKING APPARATUS FOR SELECTIVELY SECURING A LID TO A BOX

[76] Inventors: Michael R. Thornton; Allison A. Thornton, both of 1495 Oak Ter., St. Joseph, Mich. 49085

[21] Appl. No.: 354,291

[22] Filed: May 19, 1989

[51] Int. Cl.[5] ..... B65D 43/00

[52] U.S. Cl. ..... 217/56

[58] Field of Search ..... 217/56; 220/324, 326

[56] References Cited

U.S. PATENT DOCUMENTS

| | | | |
|---|---|---|---|
| 579,057 | 3/1897 | Gilliland | 292/194 |
| 996,918 | 7/1911 | Flora | 217/56 |
| 1,084,447 | 1/1914 | Kingstedt | 217/56 |
| 1,894,022 | 1/1933 | Cruser | 217/56 |
| 2,511,958 | 6/1950 | Williams | 217/56 |
| 2,910,737 | 11/1959 | MacMillan | 20/1 |
| 3,871,777 | 3/1975 | Sauer | 403/20 |

*Primary Examiner*—Donald F. Norton

*Attorney, Agent, or Firm*—Schapp and Hatch

[57] ABSTRACT

A locking apparatus for selectively securing a lid to a box having one or more posts depending from the lid and engageable in mating vertical bores formed in the walls of the box, elongated locking members mounted for both axial and rotational adjustment in bores formed the walls of the box in perpendicularly partially intersecting relation to the vertical bores, each post having a notch registerable with the associatd locking member and each of the locking members having a notch registerable with associated the post when placed in a predetermined rotational and axial position so that the post is prevented by the locking member from being withdrawn from its vertical bore except when the notch in the locking member is in axial and rotational registration with the post, the rotational and axial positioning of the locking member being accomplished by manually engageable knobs projecting from the box, and each locking member having spring detents for holding same in the desired rotational and axial position.

13 Claims, 2 Drawing Sheets

KEYLESS LOCKING APPARATUS FOR SELECTIVELY SECURING A LID TO A BOX

BACKGROUND OF THE INVENTION

1. Field of the Invention.

This invention relates to apparatus for selectively securing and locking a lid on a container such as a box or the like, and more particularly to locking apparatus requiring positional settings of elements projecting rom the box.

2. Description of the Prior Art. It is highly desirable to provide certain boxes and the like with lids which can selectively be locked in closed position on the box or released for removal from the box. Locking apparatus has heretofore been proposed in which the box lid is held in place by a series of permanently installed fasteners which must be damaged or destroyed in order to remove the lid, see for example U.S. Pat. No. 996,918 issued July 4, 1911 to Ellsworth E. Flora.

In some of the previous known locking apparatus, the fasteners which secure the lid to the box are semi-permanent, being held in place by screws and the like removable from the exterior of the box. An example of this type of construction may be found in U.S. Pat. No. 1,894,022, issued Jan. 10, 1933 to Victor I. Cruser. Another exemplar of this approach may be found in U.S. Pat. No. 2,511,958 issued June 20, 1950 to David G. Williams.

U.S. Pat. No. 579,057 issued Mar. 16, 1897 to James F. Gilliland discloses a box having a sliding cover held in place by a "button" or disk mounted for rotation on the end of the box and having a portion cut away so that, when the disk is rotated to bring the cut out portion out of registration with the sliding lid, the lid is held against removal and, when the button is rotated to register the cut out portion with the sliding lid, the lid may then be removed.

Other attempts to removably secure the lid in place on the box provide apparatus on the outside of the box which may easily be tampered with. An example of such structure is found in U.S. Pat. No. 1,084,447, issued Jan. 13, 1914 to Gilbert Kingstedt. The known locking devices therefore either require that the fasteners be damaged or destroyed in order to remove the lid, or make the fasteners accessible from outside the box permitting unauthorized entry.

U.S. Pat. No. 2,910,737, issued Nov. 3, 1959 to James MacMillan shows a structural toy having an ear extending from one part which can be inserted into a slot in the adjacent part, with the parts being fastened together by means of a nut and bolt. MacMillan has nothing to do with boxes or other containers.

U.S. Pat. No. 3,871,777 illustrates a mechanism for clamping a split rotary anvil onto a rotatable shaft, and also has nothing at all to do with removably locking lids onto boxes.

The above-listed patents are believed to be relevant to the present invention because they were aduced by a prior art search made by an independent searcher, and a copy of each of the above-listed patents is supplied to the Patent and Trademark herewith. The term "prior art" as used herein or in any made by or on behalf of the applicant means only that any document or thing referred to as prior art bears, directly or inferentially, a date which is earlier than the effective date of this application.

No representation nor admission is made that any of the above-listed documents is part of the prior art in any acceptation of that term, or that no more pertinent information exists.

SUMMARY OF THE INVENTION

The present invention provides a keyless locking apparatus for selectively securing a lid to a box or other container in which a cylindrical post projects from the lid for axially slideable engagement in a bore formed in a wall of the box, and an elongated cylindrical locking member mounted for axial and rotational movement in a second bore through the box wall in perpendicularly partially intersecting relation to the first named bore, the post being formed with a notch registrable with the locking member when the lid is closed, the locking member also being formed with a notch which is registrable with the post when the locking member is in a predetermined rotational and axial position whereby the post is prevented by the locking member from being withdrawn from the first bore when the notch in the locking member is not in both rotational and axial registration with the post. Settable means is provided for effecting desired rotational and axial positioning of the locking member.

Preferably, the box and its lid are generally rectangular, and a post and associated locking member are provided at each corner of the box and lid.

It has been found that where a single post and locking member is used, even at each corner, the lid may be pried up sufficiently to be able to feel out and ascertain the location of the notch in the locking member relative to the post. Thus, the locking member may be moved axially by an increment and then rotated incrementially. If the post still cannot be removed, the locking member can be moved axially another increment and the rotation by increments of the locking member repeated. Eventually, the notch in the locking member will register with the post and the post can then be withdrawn.

To avoid the described experimental prying up of the lid to feel out the location of the notch in the locking member relative to the post, a pair of closely spaced parallel posts are provided at each locking location. This exponentially increases the number of times the incremental axial and rotational movements must be repeated before discovering the positions at which the notches in the locking members register with their respective posts.

The means for effecting desired rotational and axial positioning of the locking member is preferably manually operable from the exterior of the box. Indicia in the form of axially spaced circumferential rings are provided on a portion of the locking member visible from outside the box for indicating a plurality of axial positions of the locking member. In one of such axial positions the notch in the locking member is in axial registery with the post.

Axially spaced, circumferential grooves are formed in the concealed part of the locking member and are selectively engagable with a spring loaded ball detent within the box for releasably holding the locking member in the different axial positions indicated by the rings.

Further indica is provided on the locking member exteriorly of the box and complementary indica is provided on the box in an encircling relation to the locking member for indicating a plurality of rotational positions of the locking member. In one of such rotational positions, the notch in the locking member is in rotational registry with the post. When both axial and rotational registry is accomplished, the post may easily be pulled from its bore, thus permitting removal of the lid from the box.

A plurality of detent depressions are provided in the locking member in encircling relation to the locking member in positions corresponding to the indicia on the box. The spring loaded ball detent is engagable in these detent depressions as the locking member is rotated and serve to hold the locking member against unwanted rotation once it has been set. When the ball detent is engaged in the correct groove and the correct detent depression, the notch in the locking member will be positioned to permit withdrawal of the associated post from its bore.

It is therefore a principal object of the present invention to provide a keyless locking apparatus for selectively securing a lid to a box or the like, in which externally operable locking members must be precisely positioned both axially and rotationally in order to permit removal of the lid from the box.

Another object of the present invention is to provide a keyless locking apparatus of the character described in which experimental prying up of the lid to feel out the necessary axial and rotational positioning is precluded.

A further object of the present invention is to provide a keyless locking apparatus of the character described in which predetermined rotational and axial positioning of the locking member may be observed and accomplished from the exterior of the box.

A still further object of the present invention is to provide a keyless locking apparatus of the character described in which the predeterminded rotational and axial position of each locking member may be changed to thus vary the "combination" of settings necessary to permit the box to be opened.

Other objects and features of advantage will become apparent as the specification progresses and from the claims.

Figure 1:
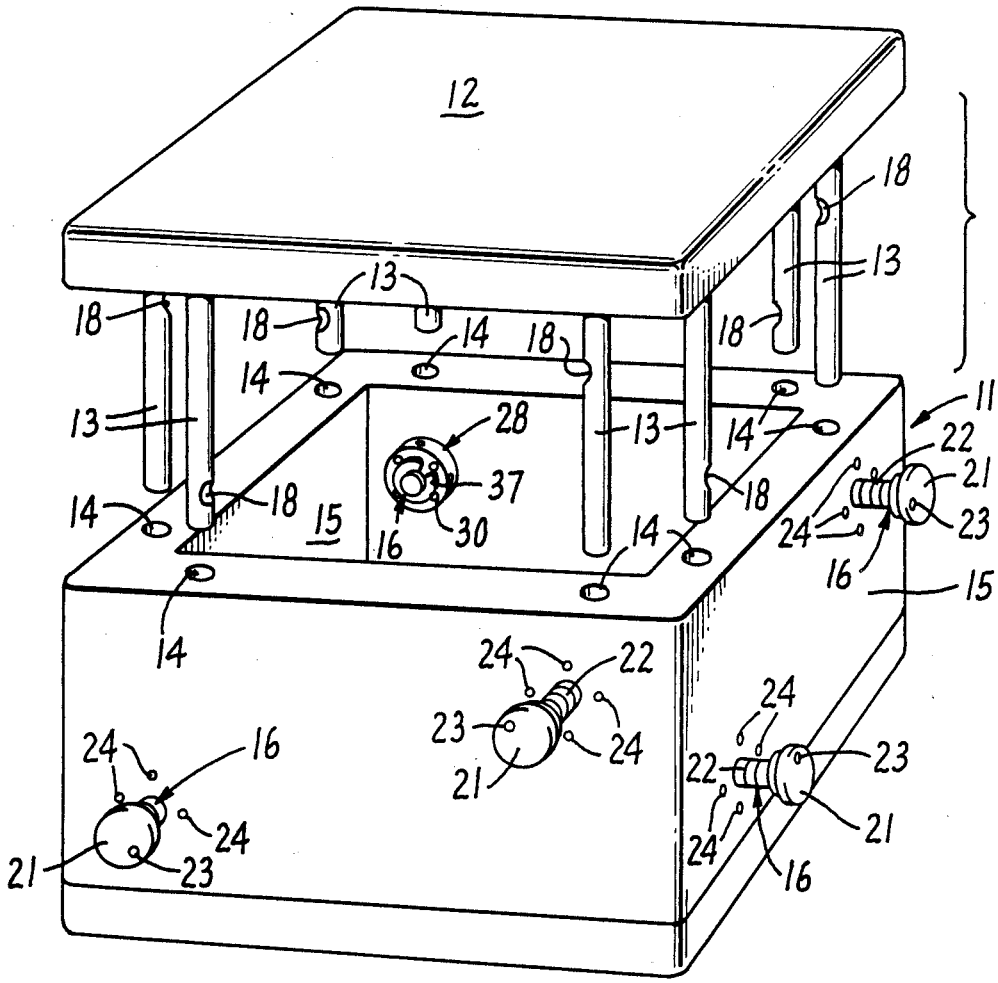
FIG. 1 is a perspective view of a box and lid constructed in accordance with the present invention, with the lid being positioned for dropping down into closed position on the box.

While only the preferred form of the invention is illustrated in the drawings, it will be apparent that various modifications could be made without departing from the ambit of the claims.

DESCRIPTION OF THE PREFERRED EMBODIMENT

As may be seen in the accompanying drawings, the keyless locking apparatus of the present invention provides a box 11 having a lid 12 and one or more posts 13 projecting from the lid 12, the box 11 being formed with bores 14 in one of its walls 15 configured to receive the posts 13. An elongated locking member 16 is engagable with each of the posts 13, the box 11 being formed with second bores 17 through the wall 15 in perpendicularly partially intersecting relation to the first bores 14. The locking members 16 are slidably mounted in their bores 17 for both axial and rotational adjustment relative to the associated bore 14. Each post 13 is formed with a notch 18 registrable with the locking member 16 when the lid 12 is positioned to close the box 11, and each locking member 16 is formed with a notch 19 registrable with the associated post 11 when the locking member 16 is in a predeterminded rotational and axial position whereby the post 13 is prevented by the locking member 16 from being withdrawn from the bore 14 when the notch 19 in the locking member 16 is not in rotational and axial registration with the post 13. Settable means 21 is provided for effecting desired rotational and axial positioning of the locking member 16.

As here shown, the box 11 and lid 12 are generally rectangular, with the box 11 having relatively thick walls 15 to accommodate the vertical bores 14. At least one of the posts 13 and an associated one of the locking members 16 are provided at each corner of the box 11 and lid 12.

Preferably, a pair of the posts 13 project in closely spaced parallel relation from the lid 12 so as to prevent experimental prying up of the lid 12 to feel out the location relative to the post 13 of the notch 19 in the locking member 16. A pair of the posts 13 and their associated locking members 16 is provided at each corner of the box 11 and lid 12. This affords eight of the locking members 16, each of which must be placed in both the correct rotational position and the correct axial position in order to permit removal of the lid 12 from the box 11.

The means 21 for effecting desired rotational and axial positioning of the locking members 16 preferably is manually operable from the exterior of the box 11. Suitable indicia, here in the form of axially spaced circumferential indicator rings 22, is provided on the portion of the locking member 16 visible from outside the box 11 for indicating a plurality of axial positions of the locking member 16. In only one of such axial positions is the notch 19 in axial registry with the post 3. Such axial registry must be accomplished before the post 13 can be withdrawn from its bore 14.

Further indicia 23 is provided on each of the locking members 16 exteriorly of the box 11. The means 21 for rotating and moving the locking member 16 axially is here in the form of a manually engagable knob, and the indicia 23 is provided on the knob 21, with complimentary indicia 24 being provided on the box 11 in encircling relation to the locking member 16 for indicating a plurality, here four, of rotational positions of the locking member 16. In only one of such rotational positions is the notch 19 in rotational registry with the post 13 to permit the post to be withdrawn from its bore 14. Thus, the notch 19 must be in both rotational and axial registry with post 13 for the latter to be removed from its bore.

Figure 3:
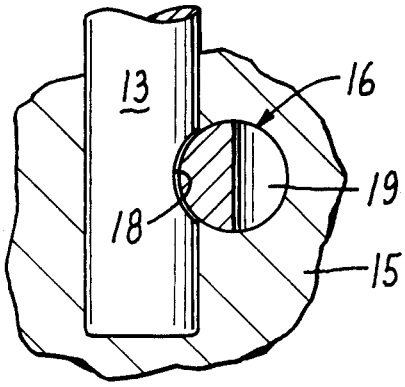
FIG. 3 is a vertical cross sectional view through a locking post and associated locking member showing the locking member in one of its rotational locking positions.
Figure 2:
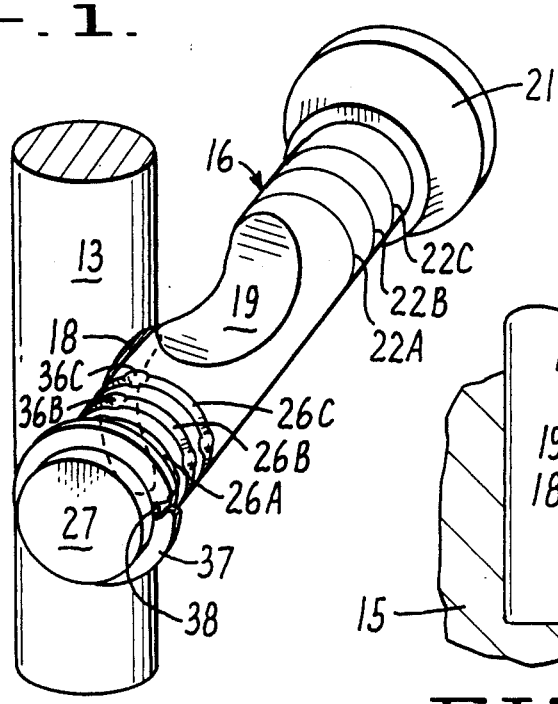
FIG. 2 is an enlarged, fragmentary detail view in perspective showing the structure of a locking member and an associated portion of a locking post constructed in accordance with the present invention.
Figure 4:
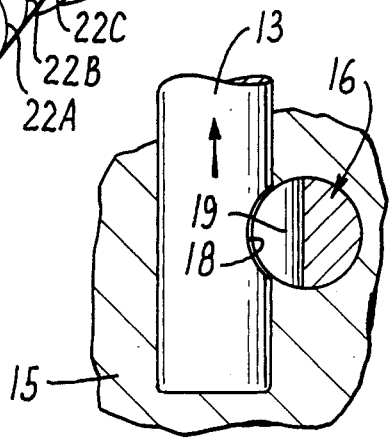
FIG. 4 is a view similar to that of FIG. 3, but illustrating the locking member rotated to register a notch therein with the post for permitting withdrawal of the post.
Figure 5:
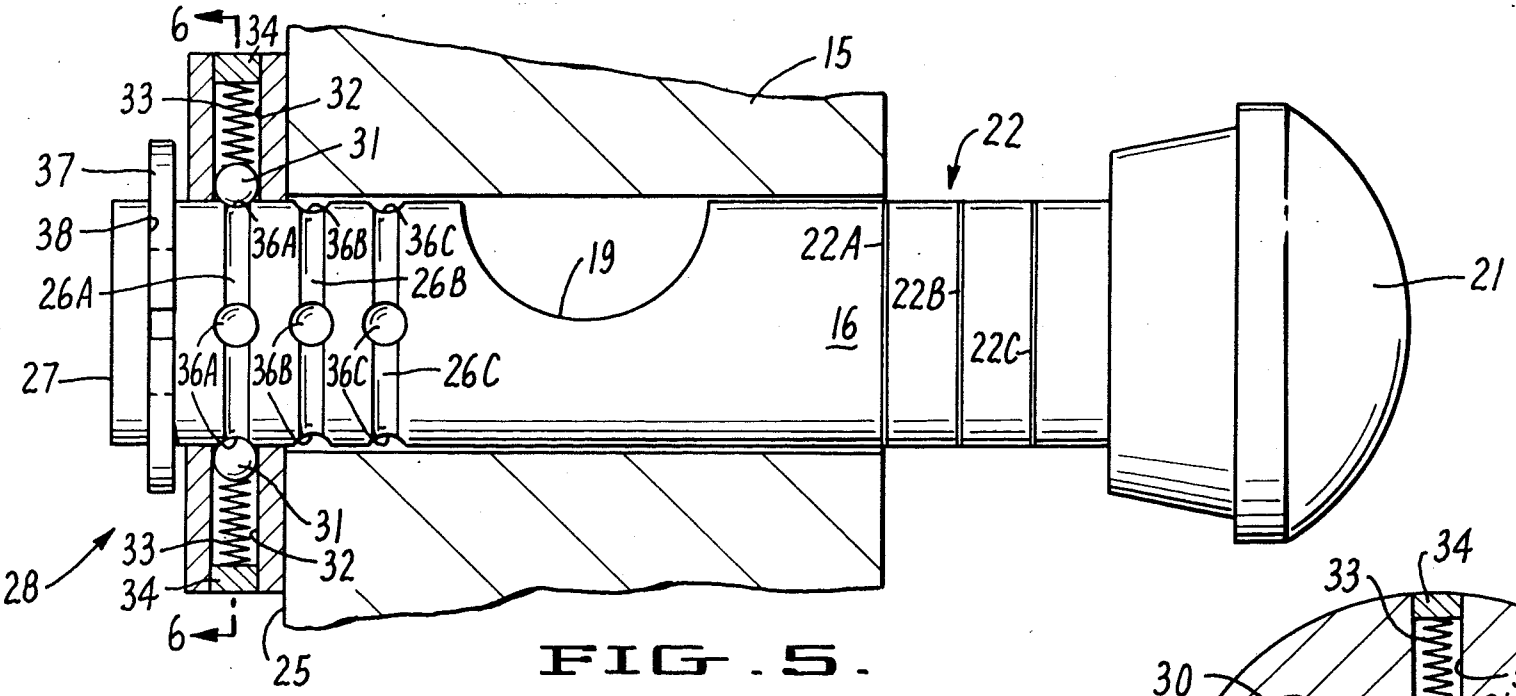
FIG. 5 is a vertical cross-sectional view on an enlarged scale taken through a portion of one of the walls of the box and illustrating rotational and axial detents used in achieving correct positioning of a locking member.

The notch 18 in the post 13 permits rotation of locking member 16 in the manner illustrated in FIG. 3 of the drawings. As shown in FIG. 3, the rotational position is not in registry with the post 13 and the post cannot be withdrawn. FIG. 4 illustrates the position of the same parts when the locking member 16 is rotated sufficiently to bring notch 19 into registry with post 13 thus freeing the post 13 for withdrawal from its bore 14.

The rotational and axial positions of the locking members 16 are thus obtainable from visual inspection of the indicia 22, 23 and 24. Since each of the locking members 16 must be in its correct rotational and axial position for alignment of the notch 19 with the post 13, each locking member must be set individually to the correct rotational and axial positions for that locking member. Because of the indicia 22, 23 and 24, these positions can be written down to provide a "combination" for releasing the locking apparatus. This combination can easily be changed to permit substitution of other locking members having the notch 19 in different rotational and/or axial positions.

Because of the multiplicity of locking members 16, and the multiple axial and rotational positions into which each locking member may be placed, it is desirable to avoid accidental rotational and/or axial dislodgement of each of the locking members 16 after it has been set to the correct axial position to permit withdrawal of its associated post 13. For this purpose, a plurality of detent grooves 26A, 26B and 26C are formed in the periphery of the locking member 16 near its inner end 27 in axially spaced relation coinciding with the axial spacing of the corresponding indicator rings 22A, 22B and 22C.

Detent means 28 is secured by screws 30 to the inner face 25 of the wall 15 of box 11 for releasably holding the locking pin 16 in the desired rotational and axial position. Detent means 28 here includes detent balls 31 slidable in radially extending bores 32 and pressed radially inwardly by a spring 33 compressed between the ball 31 and a retainer member 34 secured in the outer end of the bore 32.

In the form of the invention illustrated in the drawings, four spring loaded ball detents are mounted at 90° intervals around the locking member 16 in position to project into grooves 26A, 26B or 26C, depending upon the axial adjustment of locking member 16. The detent means 28 retains the locking member 16 in the axial position to which it is set, but can be overcome to permit intentional movement of the locking member 16 to different axial position.

Figure 6:
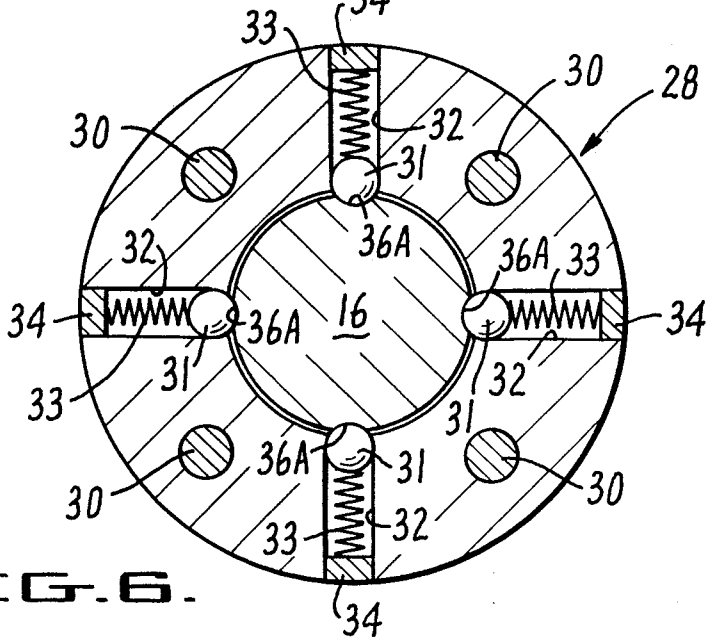
FIG. 6 is a vertical cross-sectional view on an enlarged scale of the inner end of the locking member and associated detents taken substantially on the plane of line 6—6 of FIG. 5.
Figure 7:
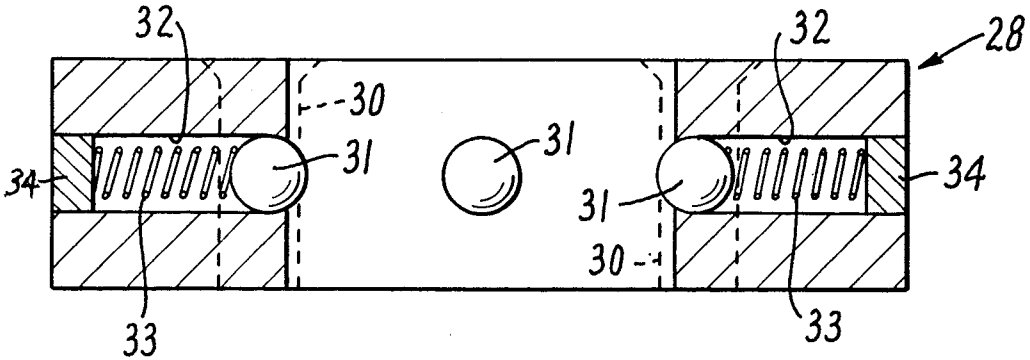
FIG. 7 is a cross-sectional view through a detent device constructed in accordance with the present invention.

To releasably retain the locking member 16 in the desired rotational position, a plurality of circumferentially spaced detent depressions 36A, 36B and 36C are formed in the outer periphery of locking member 16 at the detent grooves 26A, 26B and 26C, in the manner best seen in FIG. 6 of the drawings. Locking member 16 is rotated until the ball detents 31 snap into one of the detent depressions 36. The detent ball 31 then retains the locking member 16 against further accidental rotation, but this retaining action of detent ball 31 can be overcome for intentionally moving the locking member 16 to a different rotational position.

Each of the locking members 16 is releasably held against removal from its associated bore 17 by a U-shaped retainer clip 37 removably snapped into place in a peripheral groove 38 formed in locking member 16 adjacent to its end 27. When it is desired to change the "combination" by replacing one or more of the locking members 16, the box 11 is first opened by removing the lid 12, and the retainer clip 37 is removed from its groove 38. The locking member 16 can then be withdrawn from the wall 15 of the box 11 and replaced by a different locking member which would be of similar construction, except that the notch 19 would be in a different position.

From the foregoing, it will be apparent that the keyless locking apparatus of the present invention is particularly well suited for selectively securing a lid to a box in a manner which is difficult, if not impossible, for a person not having the correct combination to open.

What is claimed is:

1. A keyless locking apparatus for selectively securing a lid to a box, comprising a box, a lid for said box, a post projecting from said lid, said box being formed with a first bore in one of its walls configured to receive said post when said lid is closed, an elongated locking member engagable with said post, said box being formed with a second bore through said wall in perpendicularly partially intersecting relation to said first bore, said locking member being mounted in said second bore for both axial and rotational adjustment relative to said first bore, said post being formed with a notch registrable with said locking member when said lid is positioned to close said box, said locking member being formed with a notch registrable with said post to permit withdrawal of said post from said first named bore when said locking member is in a predetermined rotational and axial position, whereby said post is prevented by said locking member from being withdrawn from said first bore when said notch in said locking member is not in said predetermined rotational and axial position with said post, and settable means for effecting desired rotational and axial positioning of said locking member.

2. A keyless locking apparatus as described in claim 1, and wherein said box and said lid are generally rectangular, and one of said posts and an associated one of said locking members are provided at each corner of said box and said lid.

3. A keyless locking apparatus as described in claim 1, and wherein a pair of said posts project in closely spaced parallel relation from said lid so as to prevent experimental prying up of said lid to feel out the location of said notch in said locking member relative to said post.

4. A keyless locking apparatus as described in claim 3, and wherein said box and lid are generally rectangular, and wherein a pair of said posts and their said locking members are provided at each corner of said box and said lid.

5. A keyless locking apparatus as described in claim 1, and wherein said settable means for effecting desired rotational and axial positioning of said locking member is manually operable from the exterior of said box.

6. A keyless locking apparatus as described in claim 5, and wherein indicia is provided on a portion of said locking member visible from outside said box for indicating a plurality of axial positions of said locking member, in one of which said axial positions said notch in said locking member is in axial registry with said post.

7. A keyless locking apparatus as described in claim 6, and wherein said indicia on said locking member for indicating said plurality of axial positions of said locking member comprises a plurality of axially spaced indicator rings alignable with the outer face of said wall through which said locking member is mounted.

8. A keyless locking apparatus as described in claim 7, and wherein a plurality of detent grooves are formed in the periphery of said locking member near its inner end in axially spaced relation coinciding with said axial spacing of said indicator rings, and a spring loaded ball detent is mounted within said box for releasable engagement with said detent grooves as said locking member is displaced axially in said second bore.

9. A keyless locking apparatus as described in claim 5, and wherein indicia is provided on said locking member exteriorly of said box, and complementary indicia is provided on said box in encircling relation to said locking member for indicating a plurality of rotational positions of said locking member, in one of which said rotational positions said notch in said locking member is in rotational registry with said post.

10. A keyless locking apparatus as described in claim 9, and wherein a plurality of detent depressions are formed in circumferentially spaced relation in said locking member in position for releasable engagement with said spring loaded ball detent upon rotation of said locking member, said depressions coinciding with the positions of said indicia on said box.

11. A keyless locking apparatus as described in claim 1, and wherein releasable means is provided in said box and on said locking member for retaining said locking member against withdrawal from its said bore.

12. A keyless locking apparatus as described in claim 11, and wherein said releasable means comprises a retainer groove in the periphery of said locking member adjacent to the end thereof within said box, and a snap-in retainer clip selectively mountable in said retainer groove.

13. A keyless locking apparatus for selectively securing a lid to a box, comprising a generally rectangular box having an open top and relatively thick walls, a rectangular lid for closing off the open top of said box, a plurality of parallel posts projecting in perpendicular relation from said lid, said box being formed with a plurality of vertical bores in its said walls configured to receive said posts as said lid is lowered toward said box, elongated locking members engagable with each of said posts, said box being formed with a lateral bore through its walls in perpendicularly partially intersecting relation to each of said vertical bores, said lateral bores slidably carrying said locking members for both axial and rotational adjustment relative to said vertical bores, each of said posts being formed with a notch registrable with said locking member when said lid is positioned to close said box, each of said locking members being formed with a notch registrable with one of said posts when placed in a desired rotational and axial position whereby such post is prevented by said locking member from being withdrawn from its said vertical bore when said notch in said locking member is not in registration with said post, and means on said locking member for effecting desired rotational and axial positioning thereof.

* * * * *